US005749663A

United States Patent [19]

Takahashi

[11] Patent Number: 5,749,663

[45] Date of Patent: May 12, 1998

[54] MULTIPLEX WRITING INSTRUMENT

[75] Inventor: Kazunari Takahashi, Yoshikawa, Japan

[73] Assignee: Pentel Kabushiki Kaisha, Japan

[21] Appl. No.: 688,442

[22] Filed: Jul. 30, 1996

[30] Foreign Application Priority Data

| | | | |
|---|---|---|---|
| Jul. 31, 1995 | [JP] | Japan | 7-214241 |
| Oct. 31, 1995 | [JP] | Japan | 7-306507 |
| Nov. 30, 1995 | [JP] | Japan | 7-336160 |
| May 30, 1996 | [JP] | Japan | 8-158879 |

[51] Int. Cl.[6] ..... B43K 7/00

[52] U.S. Cl. ..... 401/31

[58] Field of Search ..... 401/29, 30, 31, 401/32, 33, 34, 35

[56] References Cited

U.S. PATENT DOCUMENTS

| | | | |
|---|---|---|---|
| 2,181,347 | 11/1939 | Shimada | 401/31 |
| 2,526,990 | 10/1950 | Augenstein | 401/31 |
| 3,233,593 | 2/1966 | Bowlby | 401/31 |
| 3,250,254 | 5/1966 | Gerspacher | 401/31 |
| 4,165,941 | 8/1979 | Kageyama et al. | 401/31 |
| 5,584,592 | 12/1996 | Craig | 401/31 |

FOREIGN PATENT DOCUMENTS

| | | |
|---|---|---|
| 56-16312 | 4/1981 | Japan . |
| 56-35354 | 8/1981 | Japan . |

*Primary Examiner*—William E. Stoll
*Attorney, Agent, or Firm*—Adams & Wilks

[57] ABSTRACT

In a multiplex writing instrument, a plurality of writing elements including at least one mechanical pencil are provided in a barrel body and are respectively urged rearward by resilient members, and the writing elements are arranged so that a selected writing element is projected from the barrel body when a pressure member secured to a rear end of the selected writing element is made to move forward. The mechanical pencil comprises an external member connected to a corresponding pressure member, and a lead feeding mechanism disposed inside the external member, and a knock member for operating the lead feeding mechanism is disposed on the corresponding pressure member. In another mode, the mechanical pencil comprises an external member non-rotatably connected to a corresponding pressure member, and a lead feeding mechanism disposed inside the external member. A knock member for operating the lead feeding mechanism is disposed on the corresponding pressure member, and the external member is a flexible member.

4 Claims, 17 Drawing Sheets

MULTIPLEX WRITING INSTRUMENT

TECHNICAL FIELD

The present invention relates to a multiplex writing instrument in which a plurality of writing elements including at least one mechanical pencil are provided in a barrel body and are respectively urged rearward by resilient members, the writing elements being arranged so that a selected writing element is projected from the barrel body when a pressure member secured to a rear end of the selected writing element is made to move forward.

BACKGROUND ART

Known examples of a multiplex writing instrument which includes a mechanical pencil as one writing element are disclosed in Japanese Utility Model Publication Nos. 56-35354/1981 and 56-16312/1981.

In either of these prior arts, a member for operating a mechanism for feeding a lead forward from a mechanical pencil (a finger-press element in the former art or slider in the latter art) serves as an engagement member for preventing the mechanical pencil from moving back into a barrel body when the mechanical pencil is projected from the barrel body. However, in a writing instrument arranged in this manner, almost all loads applied to a projected lead during writing are also applied to the engagement portion of the engagement member. If the loads due to writing are applied to the engagement portion, the writing instrument is brought to a state similar to the state in which the lead feeding mechanism is operated by pressing, i.e., a chuck is made open and the lead moves back.

To cope with this problem, there is also an arrangement which uses a chuck having a sawtoothed lead biting portion capable of biting a lead to prevent backward movement of the lead. However, the effect of such arrangement is limited, and if a large biting force works on a lead, the lead is broken.

In another arrangement, a spring (for opening and closing a chuck and feeding a lead forward) having a large resilient force is used to prevent the lead feeding mechanism from easily operating. However, when a lead is to be fed forward, a large force is needed and a pressing operation becomes difficult to perform. In addition, since a large gripping force is applied to the lead, the lead may be broken.

DISCLOSURE OF THE INVENTION

The present invention has been made to solve the above-described problems, and its object is to provide a multiplex writing instrument in which a plurality of writing elements including at least one mechanical pencil are provided in a barrel body and are respectively urged rearward by resilient members, the writing elements being arranged so that a selected writing element is projected from the barrel body when a pressure member secured to a rear end of the selected writing element is made to move forward, and in which the mechanical pencil comprises an external member connected to a corresponding pressure member, and a lead feeding mechanism disposed inside the external member, a knock member for operating the lead feeding mechanism being disposed on the corresponding pressure member.

The external member of the mechanical pencil is fixedly engaged with the barrel body, and the lead feeding mechanism is operated by a knock member which operates independently of the external container.

BEST MODE FOR CARRYING OUT THE INVENTION

Figure 1:
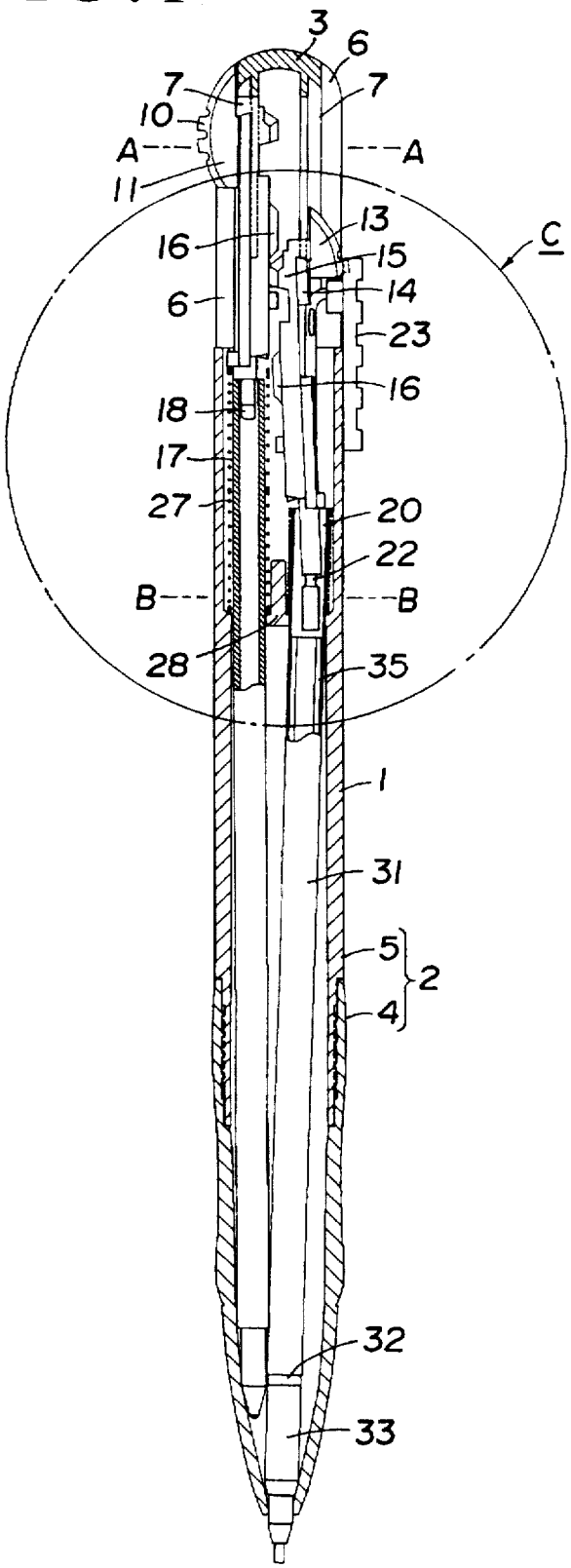
FIG. 1 is a longitudinal sectional view showing an embodiment of the present invention.

FIGS. 1 to 6 are explanatory views showing one embodiment. The shown embodiment is a multiplex writing instrument in which a mechanical pencil and two ball-point pens are slidably disposed. Although in the shown embodiment one kind of mechanical pencil is combined with two ball-point pens, a plurality of mechanical pencils each having a different lead diameter may be incorporated in a multiplex writing instrument, or two or more kinds of color mechanical pencils may be combined with a ball-point pen. Reference numeral 1 denotes a barrel body which is composed of a front barrel 2 and a rear barrel 3. Although in the present embodiment the front barrel 2 has a structure in which a point member 4 is screwed onto a middle barrel 5, the point member 4 and the middle barrel 5 may be secured to each other by press fitting or engagement, or the point member 4 and the middle barrel 5 may be integrally formed.

Three slits 6 are formed in the rear barrel 3 in such a manner as to extend in the longitudinal direction thereof. Although in the present embodiment the three slits 6 are formed because three writing elements, i.e., one mechanical pencil and two ball-point pens, are incorporated in the barrel body 1, the number of slits to be formed may be changed according to the number of writing elements to be incorporated. The slits 6 are formed to extend to one end of the rear barrel 3, and slide grooves 7 are formed in the rear barrel 3 in such a manner as to extend in the longitudinal direction thereof and on the opposite sides of each of the slits 6. The slide grooves 7 are formed to extend not over the entire length of each of the slits 6 but to an intermediate portion thereof.

Figure 3:
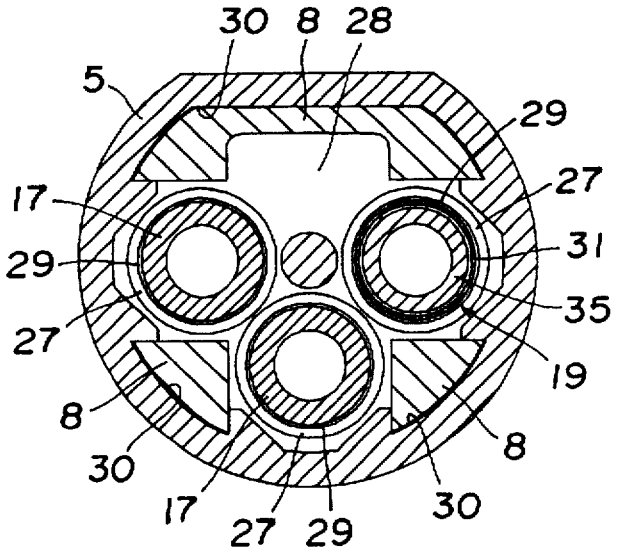
FIG. 3 is a cross-sectional view taken along line B—B of FIG. 1, showing the state in which the slider 13 is retracted.
Figure 4:
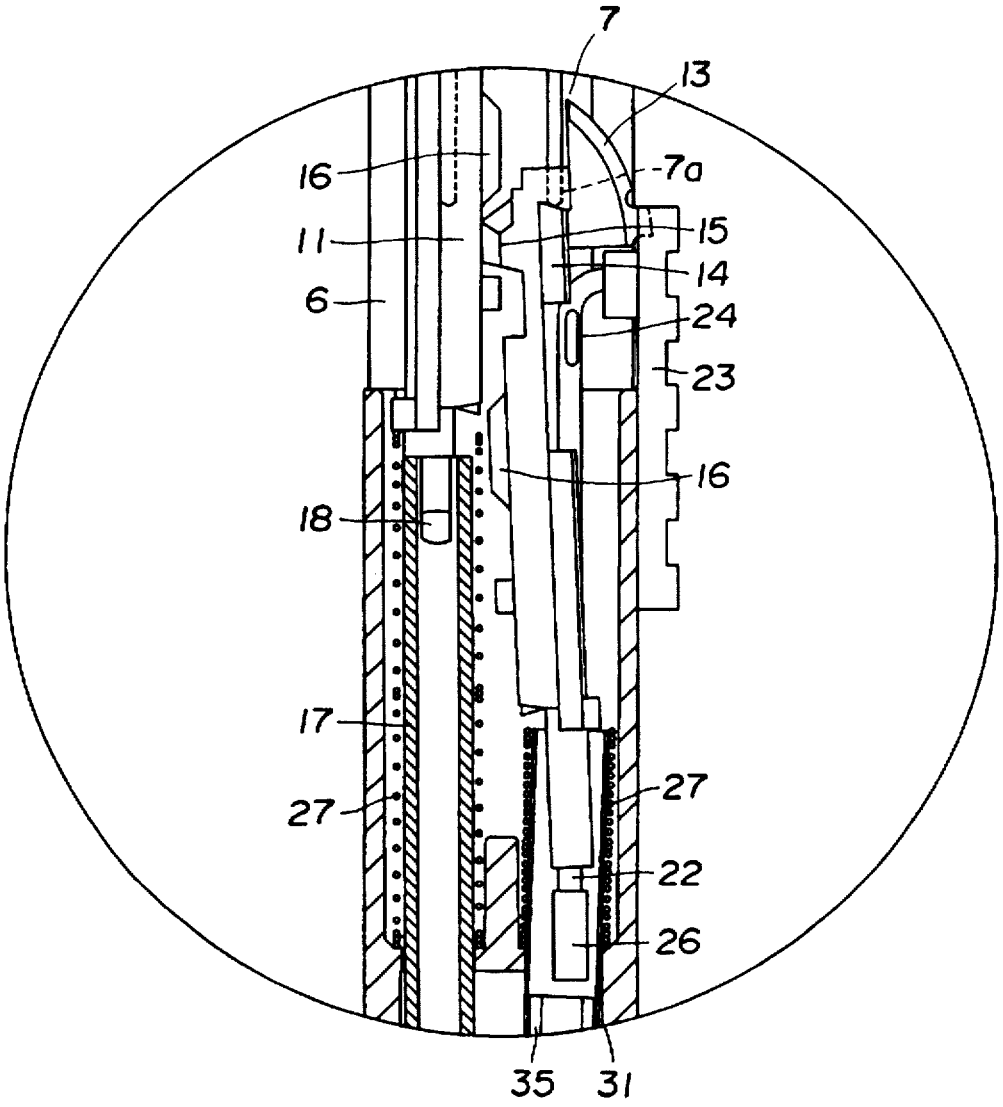
FIG. 4 is an enlarged view of a portion C of FIG. 1.
Figure 5:
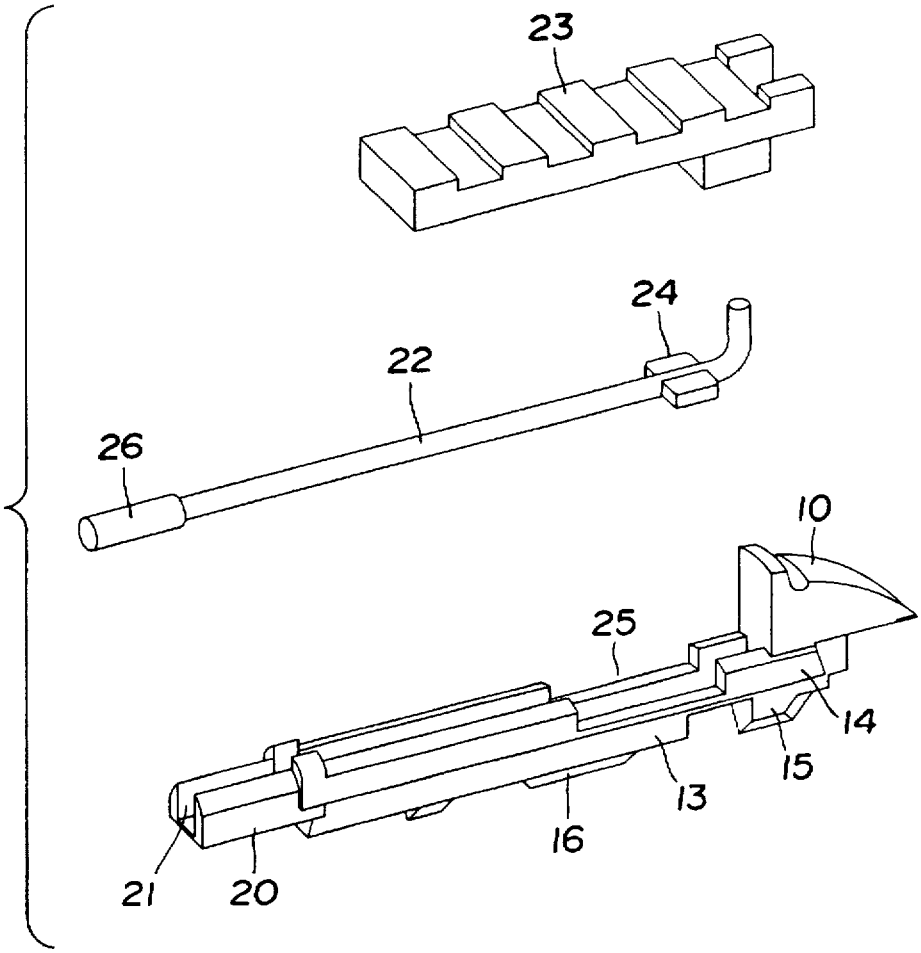
FIG. 5 is a perspective view showing the slider and its peripheral parts in the present invention.

Leg portions 8 are formed in a forward portion of the rear barrel 3. The leg portions 8 are formed at the same time that the slits 6 are formed. Therefore, the number of the leg portions 8 may be changed according to the number of writing elements to be incorporated. The lengths of the leg portions 8 are not the same but different. Specifically, the leg portion 8 shown on the upper side of FIG. 3 is made shorter than the other two leg portions 8 shown on the lower side of FIG. 3. This is intended to facilitate the incorporation of the rear barrel 3 into the middle barrel 5, as will be described later.

Figure 2:
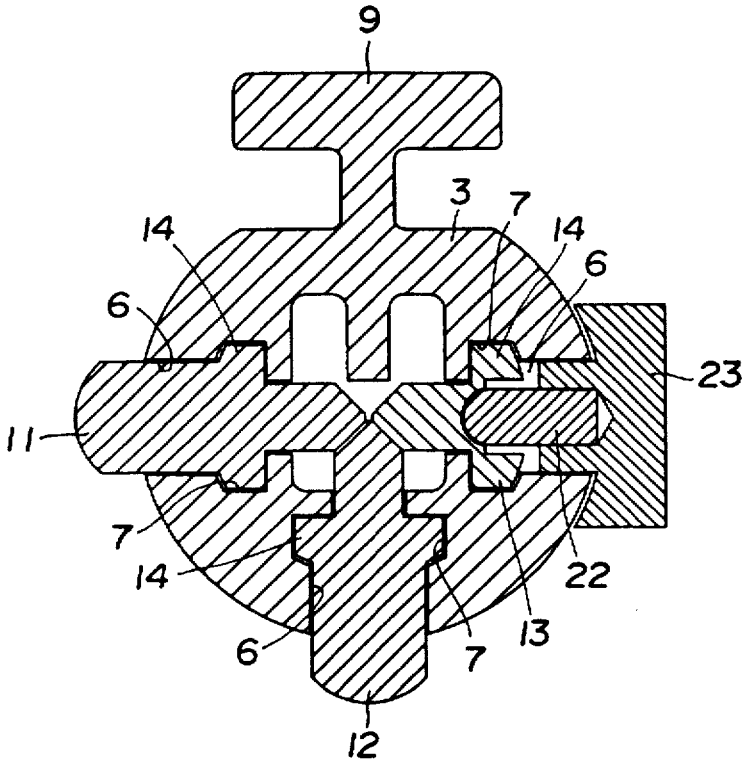
FIG. 2 is a cross-sectional view taken along line A—A of FIG. 1, showing the state in which a slider 13 is retracted.

In FIG. 2, reference numeral 9 denotes a clip portion which is formed on a side surface of the rear barrel 3.

Sliders 11, 12 and 13 are slidably disposed in the respective slits 6 of the rear barrel 3. Each of the sliders (pressure members) 11 and 12 has a toothed portion 10 to be touched by a finger and is provided for projecting and retracting the corresponding one of the ball-point pens from and into the barrel body 1, while the slider 13 is provided for projecting and retracting the mechanical pencil from and into the barrel body 1. Slide projections 14 are formed on the opposite sides of each of the sliders 11, 12 and 13 in such a manner as to extend in the longitudinal direction thereof, and are slidably engaged with the respective slide grooves 7 which are formed in conjunction with each of the slits 6. Two release projections 15 and 16 are formed on the back face of each of the sliders 11, 12 and 13 in such a manner as to be spaced apart from each other A spherical connecting portion 18 to which one writing element, i.e., a ball-point pen 17, is connected is formed at the front end of each of the sliders 11 and 12, while a press-fitting portion 20 to which a mechanical pencil 19 is connected is formed at the front end of the remaining slider 13.

A knock groove 21 is formed in the longitudinal central portion of the slider 13 for projecting and retracting the mechanical pencil from and into the barrel body 1, and an L-shaped connecting rod 22 is slidably disposed in the knock groove 21. A knock button (knock member) 23 for giving a travelling movement to the connecting rod 22 is fixed to one end portion of the connecting rod 22. Reference numeral 24 denotes a projection which is fixed to an intermediate portion of the connecting rod 22. The projections 24 slide in a recess 25 formed in an intermediate portion of the slider 13, to prevent rotation of the connecting rod 22 and the knock button 23 and ejection of the connecting rod 22 and the knock button 23 from the barrel body 1. Reference numeral 26 denotes a pressure member which is provided at the other end of the connecting rod 22 for pressing the rear end of a lead tank which will be described later. The pressure member 26 is formed to have a diameter slightly larger than the diameter of the connecting rod 22.

Reference numeral 27 denotes resilient members, such as coil springs, for urging rearward the two ball-point pens 17 and the mechanical pencil 19 as well as the sliders 11, 12 and 13 connected to these writing elements.

A restriction portion 28 is formed in an intermediate portion of the middle barrel 5 which is one member of the front barrel 2, and three through-holes 29 are formed in the restriction portion 28 through which the respective writing elements are movably inserted. One end of each of the resilient members 27 is engaged with the restriction portion 28, whereby the writing elements are respectively urged rearward by the resilient members 27.

Three grooves 30 are formed in the inside face of the middle barrel 5 and rearward of the restriction portion 28 in such a manner as to extend in the longitudinal direction. During assembly, the leg portions 8 of the rear barrel 3 are guided by sliding contact with the grooves 30, respectively.

The point member 4 which is the other member of the front barrel 2 is removably fixed to the middle barrel 5 by screwing. Although the point member 4 and the middle barrel 5 may be integrally formed, it is preferable that they be formed as two separate members to be removably fixed to each other, for the sake of ease of changing of the writing elements, such as the ball-point pens 17 or the mechanical pencil 19, or for the sake of ease of formation of the point member 4 and the middle barrel 5.

Although the inside face of the point member 4 is curved inward, the angle of inclination of each line tangential to the curve of the inside face is set smaller than the angle of inclination of each line which connects the tip of any of the writing elements and the diametrical portion thereof. This is intended to prevent the tip end of any of the writing elements from coming into contact with the inside face of the point member 4 while the writing element is travelling in the point member 4, thereby preventing contamination of the inside face of a transparent barrel which has recently been popular. In the case of conventional writing instruments, particularly if a ball-point pen is incorporated as a writing element, the ink of the ball-point pen will adhere to the inside face of the barrel and impair the aesthetic effect of the writing instrument.

Figure 6:
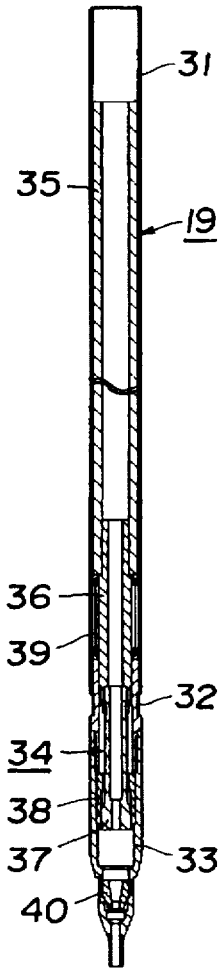
FIG. 6 is a diagrammatic longitudinal sectional view showing a mechanical pencil.

The mechanical pencil 19 will be described below (refer to FIG. 6). The rear end portion of an external container (external member) 31, which is made from a pipe made of a resin, preferably a metal, is connected to the press-fitting portion (connecting portion) 20 of the slider 13. A point member 33 is fixed to the point end of the external container 31 via a connecting member 32, as by press fitting, and a lead feeding mechanism 34 is slidably disposed in the external container 31, the connecting member 32 and the point member 33. The lead feeding mechanism 34 includes a lead tank 35 made from a pipe made of a resin, such as polyethylene or polypropylene, a chuck 37 fixed to the front of the lead tank 35 via a connecting member 36, a chuck ring 38 for opening and closing the chuck 37, a chuck spring 39 for urging the chuck 37 rearward at all times, and the like. Reference numeral 40 denotes a lead retaining member for preventing a lead from moving rearward during a lead feeding operation.

Figure 7:
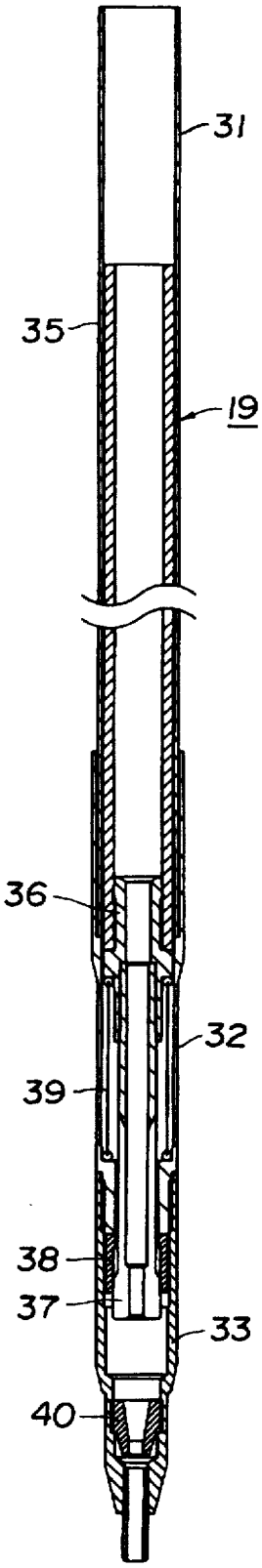
FIG. 7 is a diagrammatic longitudinal sectional view showing a modification of the mechanical pencil.

In the present embodiment, the connecting member 32 is press-fitted into the front end of the external container 31. However, as shown in FIG. 7, the connecting member 32 may be formed to have a portion extended rearward from the chuck spring 39, and the extended portion of the connecting member 32 may be press-fitted onto the front end portion of the external container 31 so that the connecting member 32 can be removed from the external container 31 to facilitate refilling of leads.

The operation of the aforesaid embodiment will be described below. If the slider 13 connected to the mechanical pencil 19 is pressed forward (downward in the Figure), the slider 13 is moved forward along with the mechanical pencil 19 while being guided by the corresponding slit 6 and slide grooves 7, so that the tip of the point member 33 of the mechanical pencil 19 is projected from the front end of the barrel body 1. At the same time, the slider 13 is pressed into the barrel body 1, and the rear ends of the slide projections 14 formed on the opposite sides of the slider 13 engage with steps **7*a* formed at the front ends of the respective slide grooves 7, thereby preventing rearward movement of the mechanical pencil 19 (refer to FIGS. 1 and 4). In other words, since the slide grooves 7 are formed to extend to the intermediate portion of each of the slits 11, the aforesaid slide grooves 7 can also serve to engage with the slider 13**.

If a lead is to be fed forward, the knock button 23 is pressed (moved forward). As the knock button 23 is moved forward, the pressure member 26 of the connecting rod 22 presses the rear end of the lead tank 35. By this pressing operation, the chuck 37 is moved forward against the resilient force of the chuck spring 39. Thus, with the forward movement of the chuck 37, a lead is moved forward and fed from the point member 33.

Then, if the mechanical pencil 19 is to be accommodated into the barrel body 1, the slider 11 or 12 other than the slider 13 is pressed. If the slider 11 or 12 is pressed, the release projection 16 formed on the slider 11 or 12 collides with the release projection 15 formed on the slider 13. By this collision, the slider 13 placed in its pressed state is pressed in the outward direction of the barrel body 1. Then, by this pressing operation, the engagement between the slide projections 14 of the slider 13 and the steps **7*a* of the slide grooves 7 is released, and by this release operation, the mechanical pencil 19 placed in its projected state is allowed to move backward by the operation of the resilient member 27 and is retracted into the barrel body 1**.

Although in the present embodiment the resilient force of the chuck spring 39 is set larger than that of the resilient member 27, the setting of the resilient forces of the chuck spring 39 and the resilient member 27 may be reversed, i.e., the resilient force of the resilient member 27 may be set larger than that of the chuck spring 39. In this case, since the mechanical pencil 19 is projected with the chuck spring 39 placed in its pressed state, the lead can be fed forward at the same time that the mechanical pencil 19 is projected. In this case, the pressure at which the slider 13 is fitted into the external container 31 is set larger, specifically, to a level which can prevent the slider 13 from being removed from the external container 31 by the resilient force of the resilient member 27.

Figure 8:
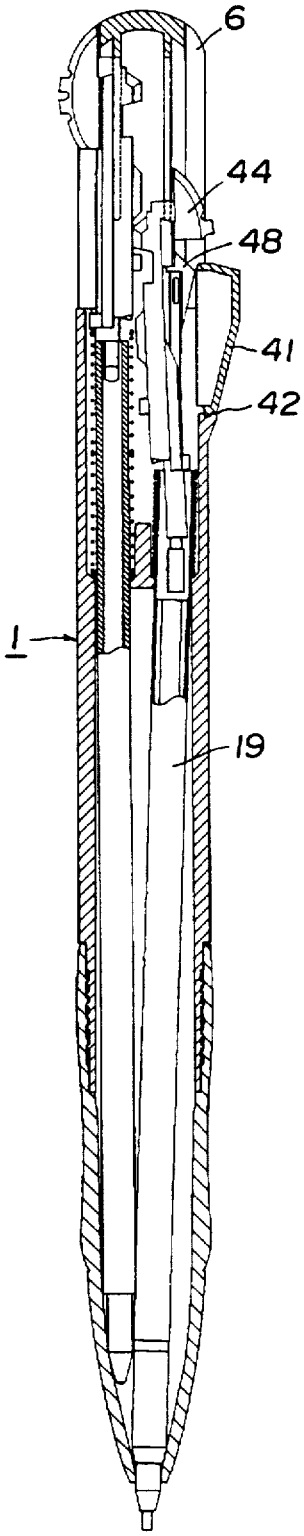
FIG. 8 is a longitudinal sectional view showing a modification of the present invention.
Figure 9:
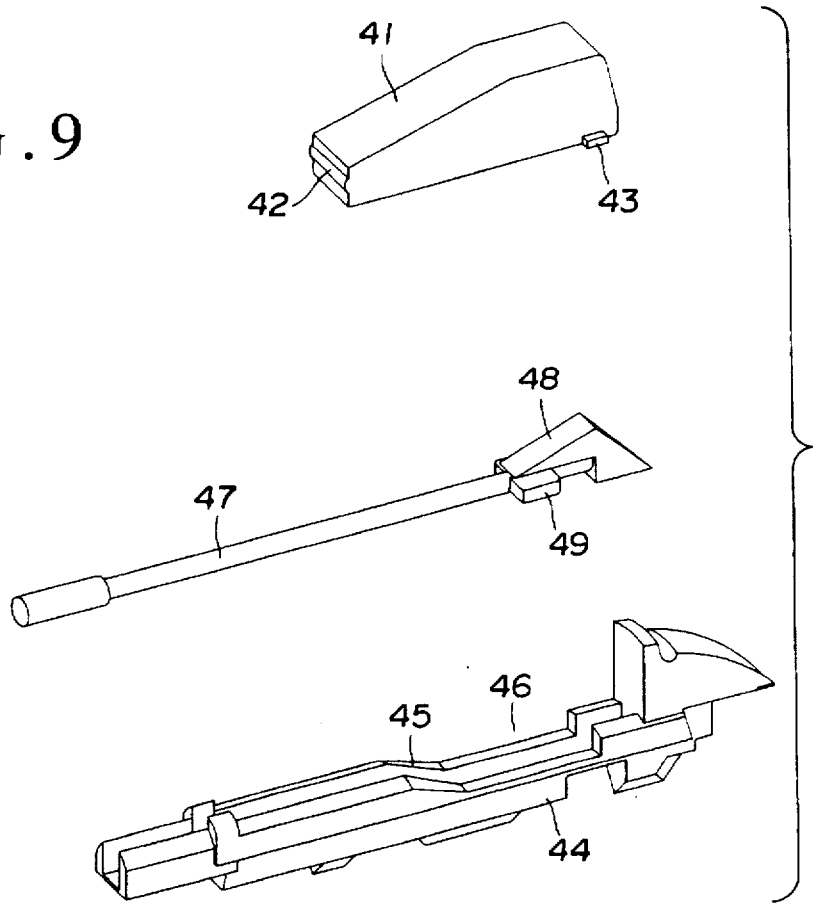
FIG. 9 is a perspective view showing a slider and its peripheral parts in the modification.

A modification of the aforesaid mechanical pencil will be described below with reference to FIGS. 8 and 9. The shown modification is a so-called side-knock type of mechanical pencil which is arranged to feed a lead forward when a knock button 41 is pressed in the radial direction of the barrel body 1. The description of constituent elements similar to those used in the aforesaid embodiment is omitted. In this modification, the one of the slits 6 which is formed in the rear end portion of the barrel body 1 has a slightly enlarged width. The knock button 41 having a C-like cross section is disposed in that slit 6 so that it can be pressed and rotated about its front end in the radial direction of the barrel body 1. As shown in FIG. 8, a projection 42 for engagement with the barrel body 1 is formed at the front end of the knock button 41, and an engagement projection 43 for preventing the knock button 41 from coming off the barrel body 1 is formed on a side face of a rear portion of the knock button 41.

A slide recess 46 having inclined faces 45 is formed in an intermediate portion of a slider 44 of the present modification which corresponds to the slider 13 of the above-described embodiment. A tapered member 48 having an inclined surface formed in the shape of a hill is fixed to one end of a connecting rod 47 of the present modification which corresponds to the connecting rod 22 of the above-described embodiment.

The tapered member 48 is moved forward by the forward movement of the slider 44, and the tapered member 48 is pressed by the knock button 41 so that the connecting rod 47 is moved forward to feed a lead forward.

Rotation preventing projections 49 are formed in an intermediate portion of the connecting rod 47 of the present modification.

Figure 10:
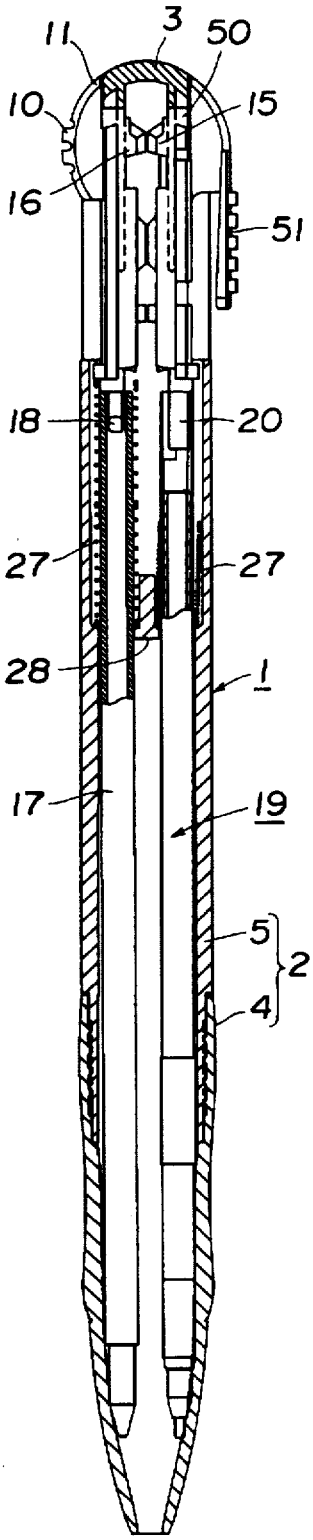
FIG. 10 is a longitudinal sectional view showing a modification of the present invention.
Figure 11:
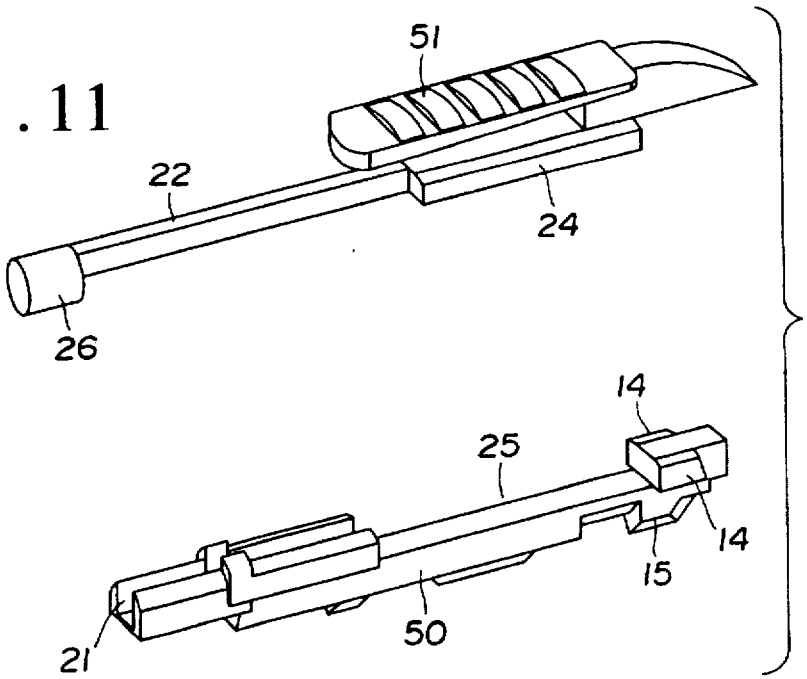
FIG. 11 is a perspective view showing the slider shown in FIG. 10 and its peripheral parts.
Figure 12:
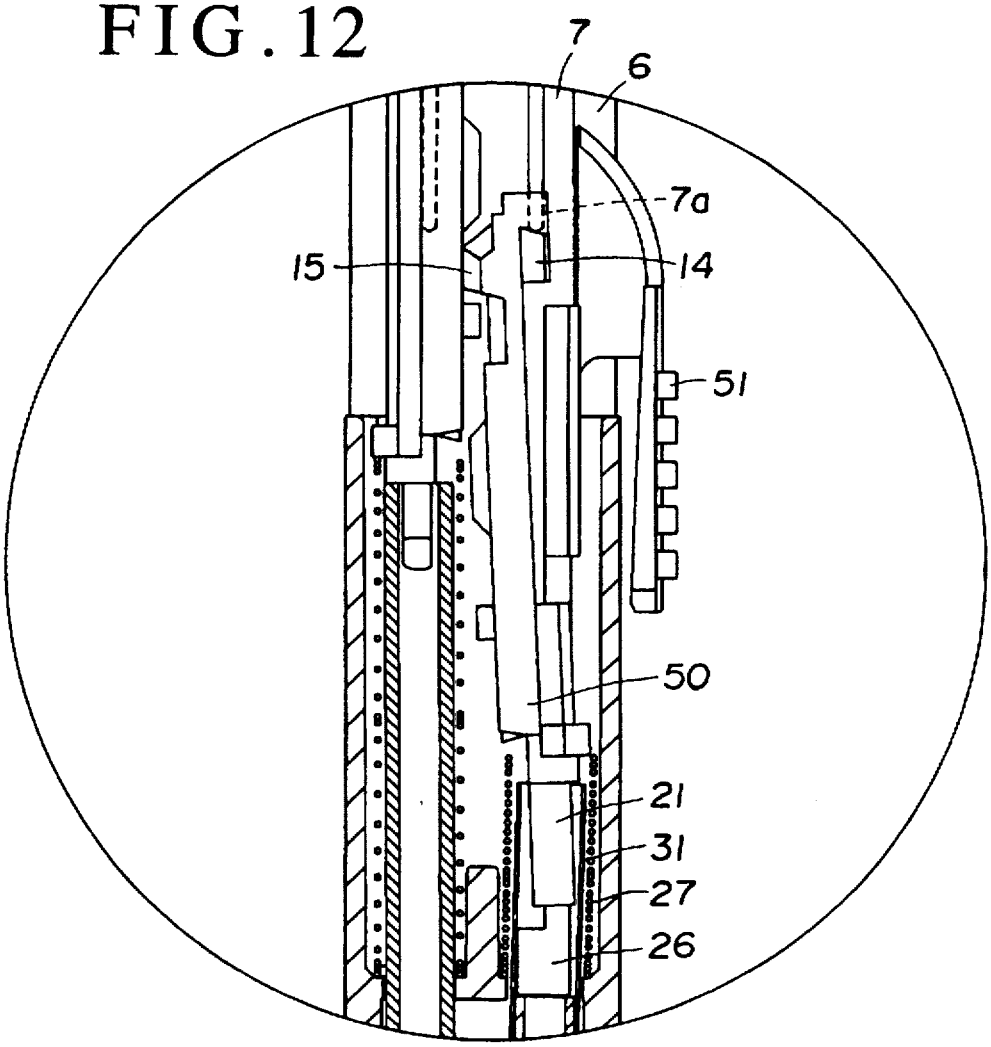
FIG. 12 is a longitudinal sectional view showing on an enlarged scale the essential portion of FIG. 10.

An example in which a slider 50 of the mechanical pencil 19 is incorporated in the barrel body 1 will be described below with reference to FIGS. 10 to 12. In this example, the toothed portion 10 which is formed on the slider 13 of the above-described embodiment is not formed, and a portion corresponding to the toothed portion 10 is formed on a knock button 51. Specifically, the knock button 51 is formed to extend rearward and longer than the above-described knock button 23, so that the slider 50 is hidden.

The operation of this example will be described below. If the knock button 51 which interlocks with the mechanical pencil 19 is pressed forward (downward as viewed in FIG. 10) in the state shown in FIG. 10, the pressure portion 26 of the connecting rod 22 comes into pressure contact with the rear end of the lead tank 35 of the mechanical pencil 19. The external container 31 is moved forward by the operation of pressing the lead tank 35, because the resilient force of the chuck spring 39 is set larger than that of the resilient member 27. As the external container 31 is moved forward, the slider 50 connected to the external container 31 is moved forward while being guided by the corresponding slit 6 and slide grooves 7, so that the slider 50 is pressed into the barrel body 1 and the rear ends of the slide projections 14 formed on the opposite sides of the slider 50 engage with the steps 7*a* formed at the front ends of the respective slide grooves 7, thereby preventing forward movement of the mechanical pencil 19 (refer to FIG. 12). During this time, the tip of the point member 33 of the mechanical pencil 19 is projected from the front end of the barrel body 1.

In this example, the knock button 23, the connecting rod 22, the projection 24 and the pressure portion 26 used in the above-described embodiment are integrally formed. Accordingly, since the slider is incorporated in the barrel body, the external appearance of the multiplex writing instrument can be improved, and since the knock button and its peripheral components are integrally formed, the costs of the components can be reduced and the assembly thereof can be facilitated.

Figure 13:
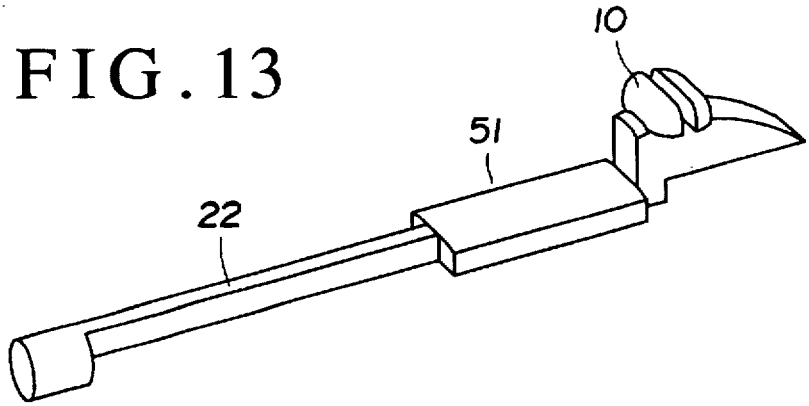
FIG. 13 is a perspective view showing a modification of the slider.

Incidentally, since the whole pressure must be applied to the knock button 51 during a pressing operation as compared with the above-described embodiment, the toothed portion 10 of the knock button 51 may be formed to be laterally enlarged, as shown in FIG. 13, so that the resisting force applied to a finger which is pressing the knock button 51 can be diffused and mitigated.

Figure 14:
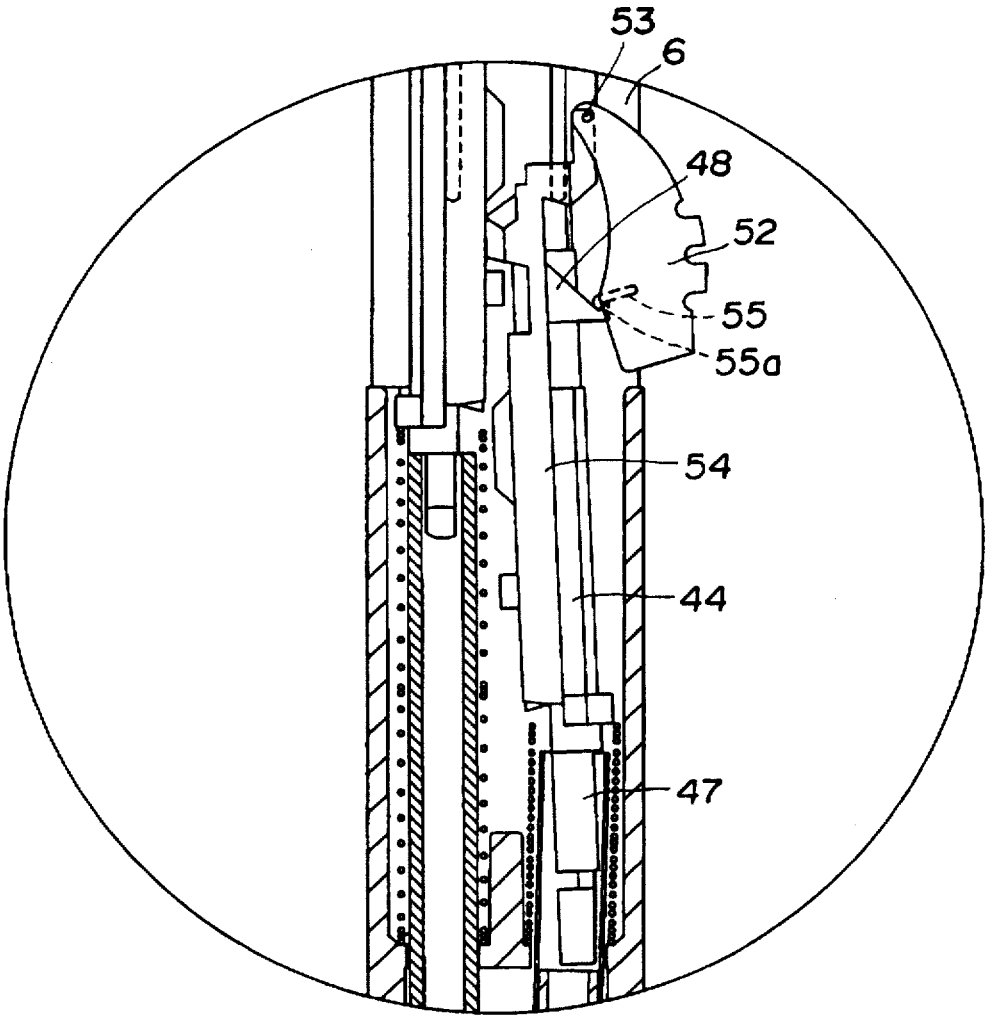
FIG. 14 is a longitudinal sectional view showing on an enlarged scale an essential portion of a modification of the present invention.
Figure 15:
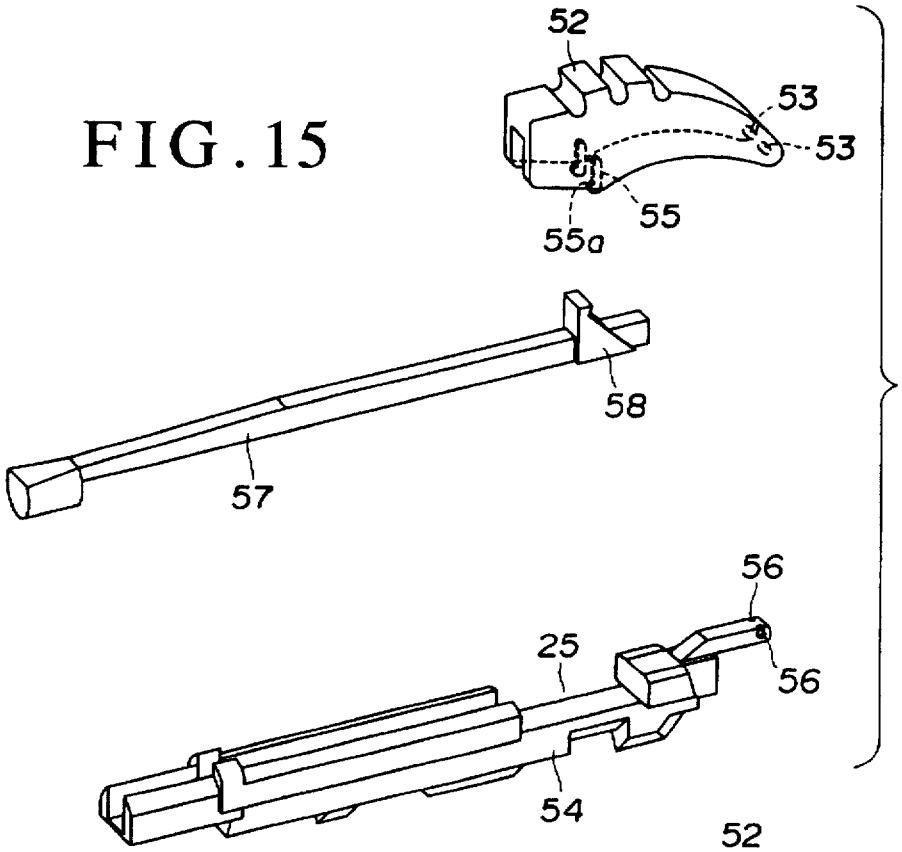
FIG. 15 is a perspective sectional view showing the slider shown in FIG. 14 and its peripheral parts.

Another modification of the aforesaid mechanical pencil will be described below with reference to FIGS. 14 and 15. This modification is a so-called side-knock type of mechanical pencil which is arranged to feed a lead forward when a knock button 52 is pressed in the radial direction of the barrel body 1.

In this modification, the one of the slits 6 which is formed in the rear end portion of the barrel body 1 has a slightly enlarged width compared to the above-described embodiment, but the width of that slit 6 may be equal to that of the corresponding slit 6 of the above-described embodiment. A knock button 52 having a C-like cross section is disposed in that slit 6 so that it can be pressed and rotated about its rear end in the radial direction of the barrel body 1. The knock button 52 has fitting pins 53 formed at the rear end, and pressure projections 55 for pressing a slider 54 which will be described later are formed on opposite inside faces of a front portion of the knock button 52. Engagement projections 55*a* for preventing the knock button 52 from coming off the barrel body 1 are formed on the respective pressure projections 55.

Figure 16:
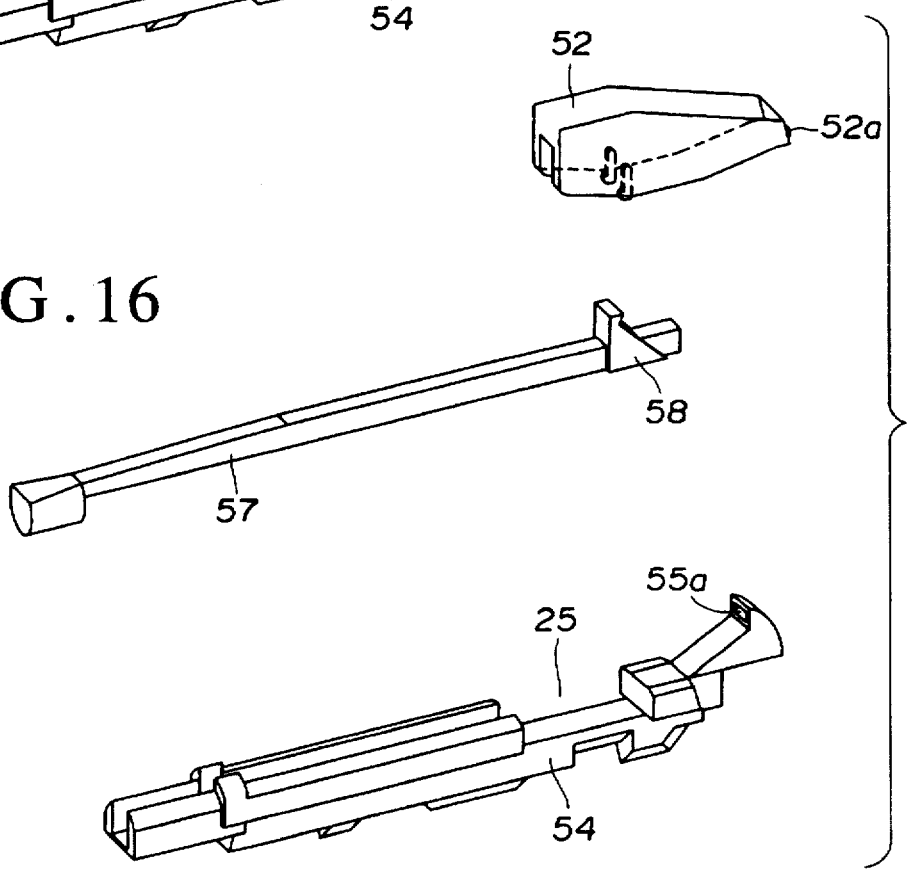
FIG. 16 is a perspective view showing a modification of the portion shown in FIG. 14.

Supporting holes 56 into which the fitting pins 53 of the knock button 52 are rotatably fitted are formed in the rear end portion of the slider 54 of this modification which corresponds to the slider 50 of the above-described modification. However, as shown in FIG. 16, the rear end (a projection 52*a*) of the knock button 52 and the rear end (a recess 54*a*) of the slider 54 may be engaged with each other. In this modification as well, the cutout 25 is formed in an intermediate portion of the slider 54. A tapered member 58 having an inclined surface formed in the shape of a hill is formed at one end portion of a connecting rod 57 of this modification which corresponds to the connecting rod 22 of the above-described embodiment. However, the tapered member 58 and the connecting rod 57 may be formed as separate members to be firmly fixed to each other In operation, the connecting rod 57 and the mechanical pencil 19 are moved forward with the forward movement of the knock button 52. The slider 54 is also moved forward with the forward movement of the mechanical pencil 19. Then, when the knock button 52 is pressed in the radial direction, the tapered member 58 and the connecting rod 57 are moved forward, so that a lead is fed forward.

Various modifications of the external container 31 will be described below. Each of the modifications is intended to smoothly project the mechanical pencil 19 from the barrel body 1 by forming the external container 31 as a tube which can be easily curved. Incidentally, although the external container 31 may be made from a flexible member made of a resin, such as polypropylene, polystyrene or polybutylene terephthalate, the external container 31 is preferably made of a metal in terms of the flexure or shrinkage of the external container 31 during writing.

Figure 17:
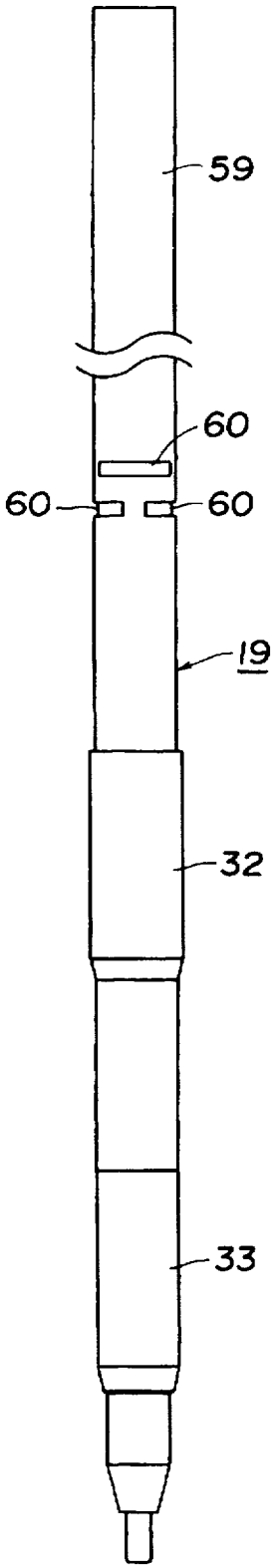
FIG. 17 is a schematic view showing the external appearance of a first modification of an external container.
Figure 18:
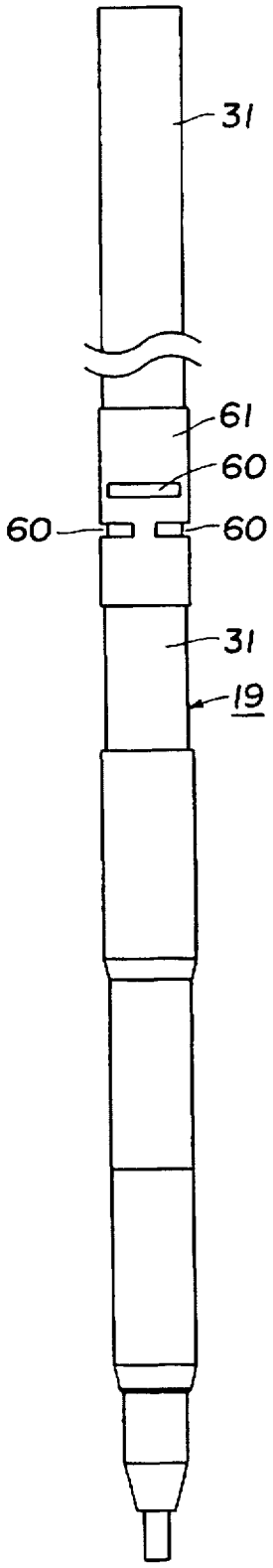
FIG. 18 is a schematic view showing a modification of the portion shown in FIG. 16.

FIG. 17 is a view showing a first modification in which cuts 60 are formed in a rear portion of an intermediate portion of an external container 59 made of a metal. As shown in FIG. 18, the external container 31 may be composed of two separate parts joined by a pipe 61 in which the cuts 60 are formed. Each of the cuts 60 is formed over an angular extent of approximately 150 degrees, and the cuts 60 are formed at locations which are diametrically opposed to each other and longitudinally 90 degrees out of phase with each other. Accordingly, if a force is applied to the external container 59 (31) in an direction owing to a rotation of the mechanical pencil 19, the external container 59 (31) can be curved. The cuts 60 are formed in a portion which is distant from the front end of the point member 33 by a distance greater than the length of leads to be used, whereby the leads can be prevented from being broken in the lead tank 35 by the flexure of the external container 59 (31) in the portion in which the cuts 60 are formed.

Figure 19:
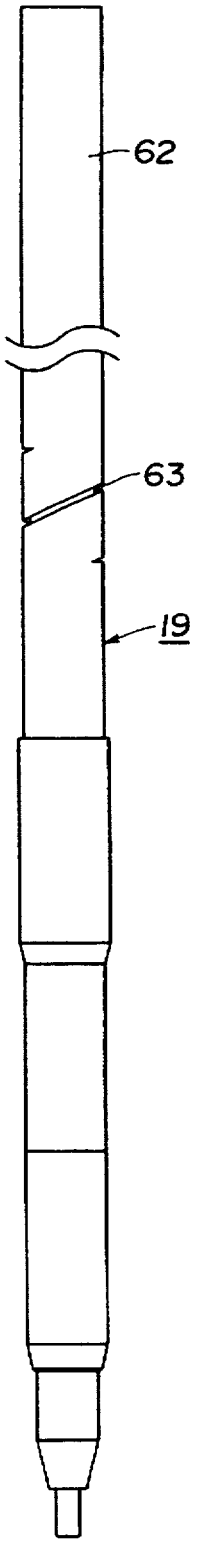
FIG. 19 is a schematic view showing a second modification of the external container.
Figure 20:
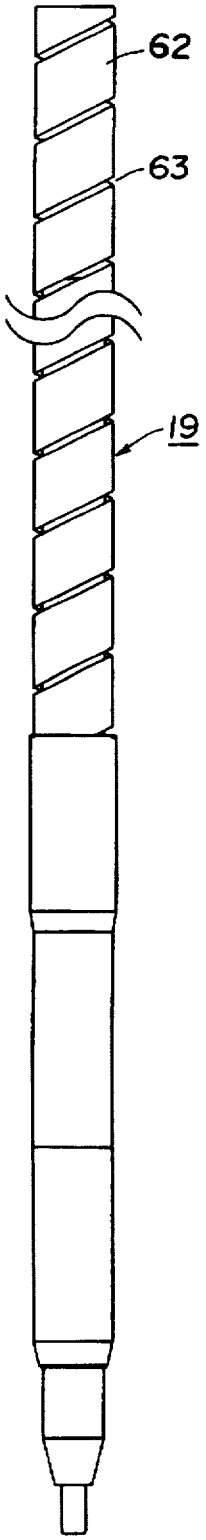
FIG. 20 is a schematic view showing a modification of the portion shown in FIG. 18.

FIGS. 19 and 20 are views showing a second modification in which a spiral cut 63 is formed in an external container 62. FIG. 19 shows one example in which the spiral cut 63 is formed in part of an intermediate portion of the external container 62, and FIG. 20 shows another example in which the spiral cut 63 is formed over the entire length of the external container 62. Since the cut 63 is formed in the spiral shape, elasticity is imparted to the external container 62, so that the external container 62 can be curved during the forward movement of the mechanical pencil 19.

Figure 21:
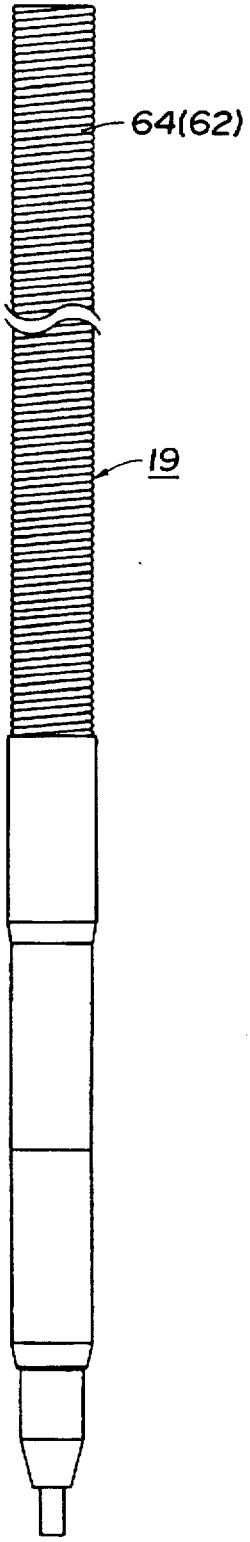
FIG. 21 is a schematic view showing a third modification of the external container.

FIG. 21 is a view showing a third modification in which a coil spring 64 is used as an external member (corresponding to the aforesaid external container). As compared with the above-described second modification, the external member can be easily curved over the entire length thereof, and if a commercially available coil spring is used, the required number of manufacturing steps can be reduced so that low-cost manufacture can be realized.

Figure 22:
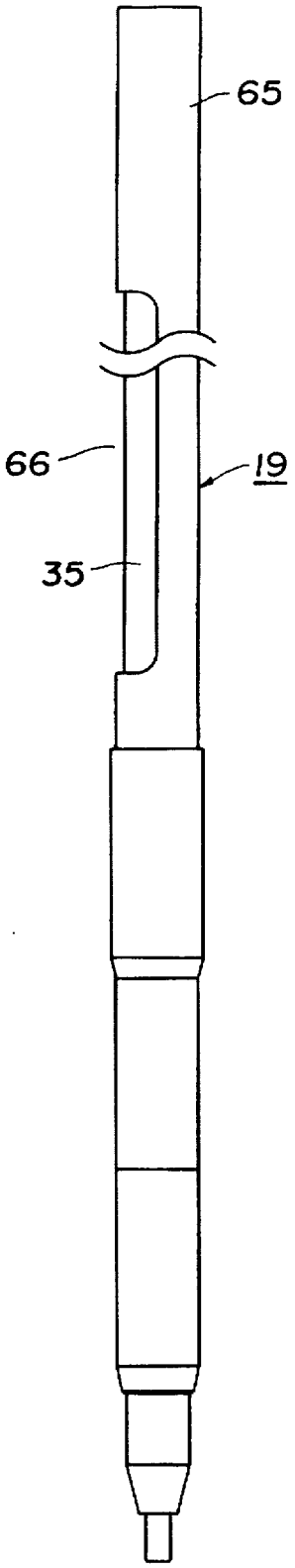
FIG. 22 is a schematic view showing a fourth modification of the external container.
Figure 23:
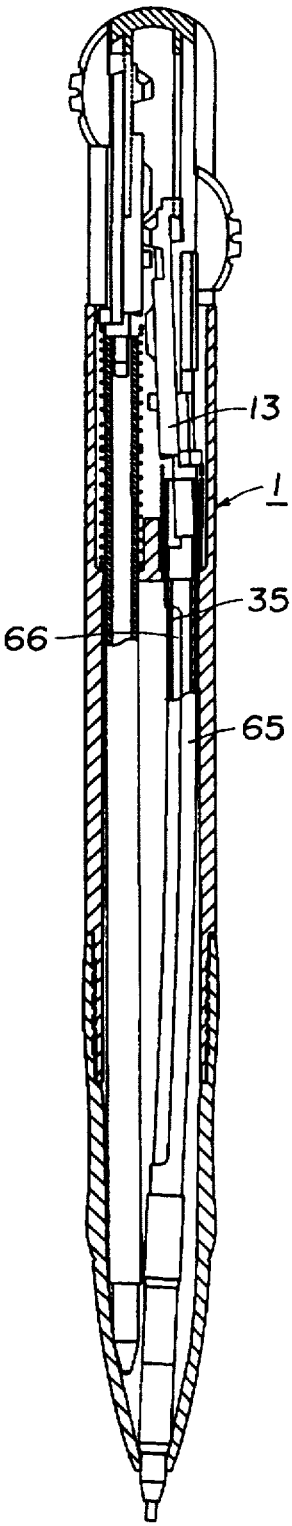
FIG. 23 is a diagrammatic longitudinal sectional view showing the state in which the fourth modification of the external container is incorporated in a barrel body.

FIG. 22 is a view showing a fourth embodiment in which a cutout 66 which extends longitudinally is formed in the peripheral side of an external container 65. The lead tank 35 is formed of a transparent material, such as polyethylene or polypropylene, so that a user can check the number of leads remaining in the lead tank 35. Although the cutout 66 is formed in the tubular external container 65, a cutout may be formed in a flat plate member in advance and then the flat plate member may be formed into an external container having a tubular shape. FIG. 23 is a view showing that the mechanical pencil 19 of the fourth modification is incorporated in the barrel body 1. As shown, the mechanical pencil 19 is fitted so that the cutout 66 is positioned in the direction in which the mechanical pencil 19 is to be curved, because the external container 65 can be easily curved. However, the mechanical pencil 19 may be fitted so that the cutout 66 is located on the opposite side, whereby a user can check the number of leads remaining in the lead tank 35 far more easily. Incidentally, the mechanical pencil 19 (the external container 65) may be oriented in accordance with the engagement-positional relationship between the slider 50 and the external tube 31.

Figure 24:
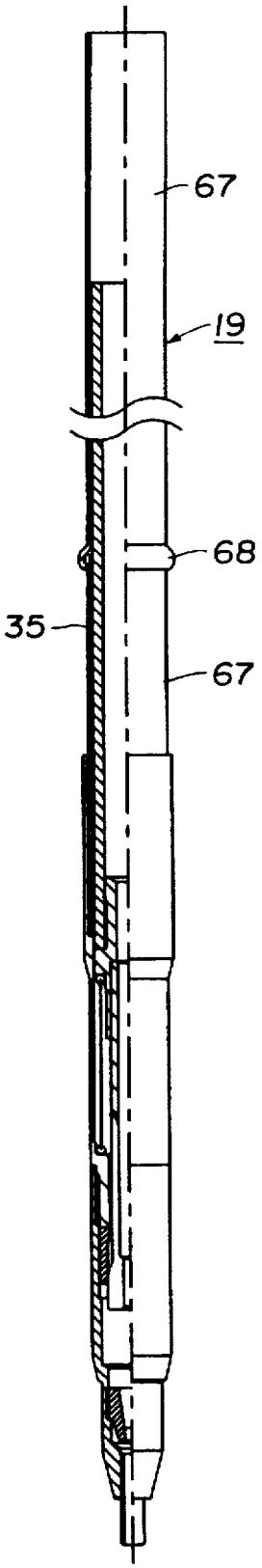
FIG. 24 is a schematic view showing the external appearance of a fifth modification of the external container.

FIG. 24 is a view showing a fifth modification in which an external container 67 is composed of two separate parts joined by caulking. The separate parts are caulked at a caulking portion 68 with a slight clearance (play) so that the external container 67 can be bent at the caulking portion 68.

Figure 25:
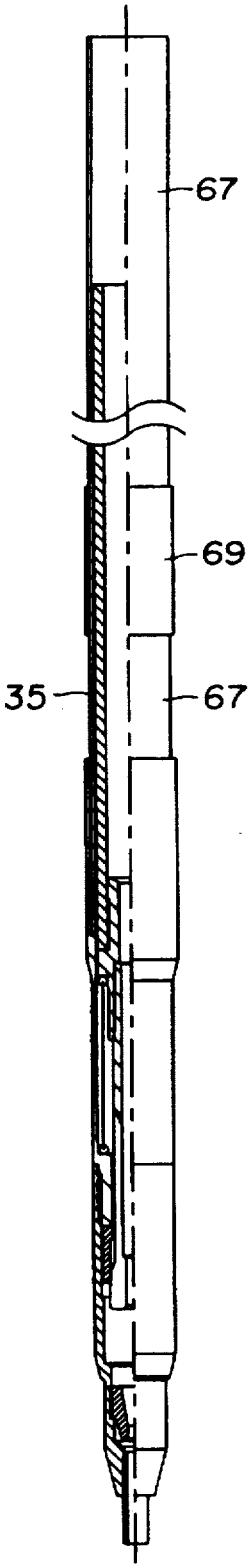
FIG. 25 is a schematic view showing the external appearance of a sixth modification of the external container.
Figure 26:
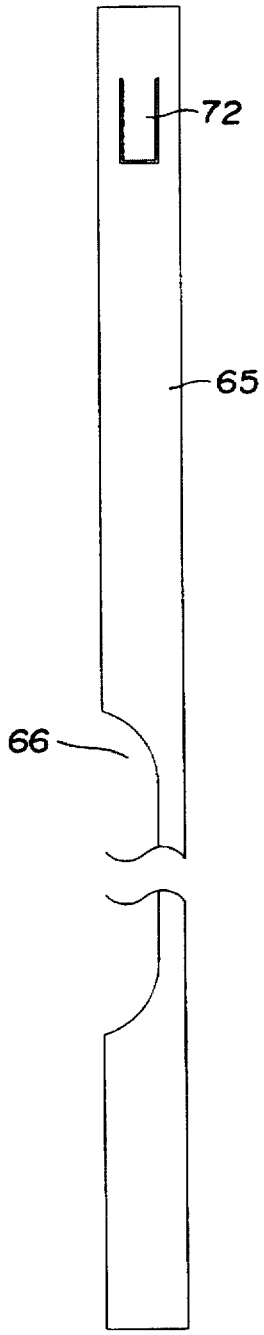
FIG. 26 is a longitudinal sectional view of the front-side essential portion of the external container, showing a first example of a rotation preventing mechanism.
Figure 27:
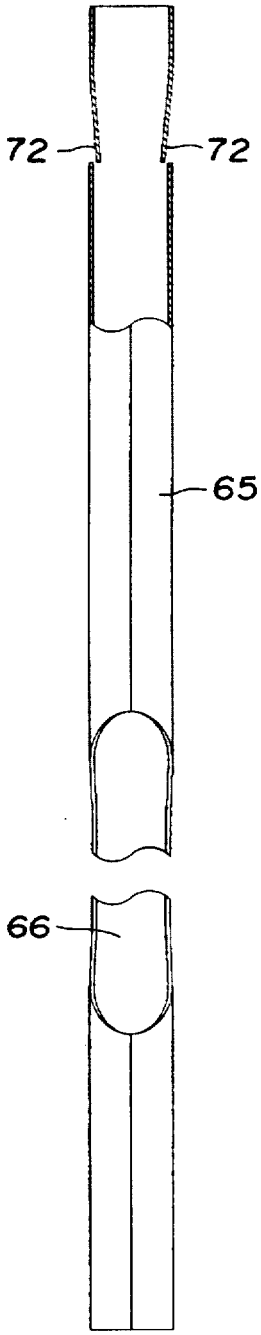
FIG. 27 is a side elevational view of FIG. 26.
Figure 28:
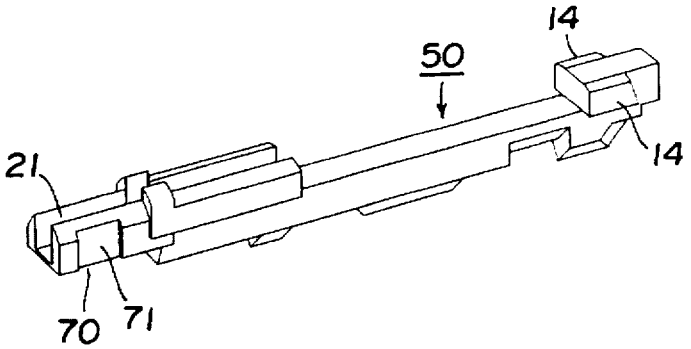
FIG. 28 is a perspective view showing a slider of the first example.
Figure 29:
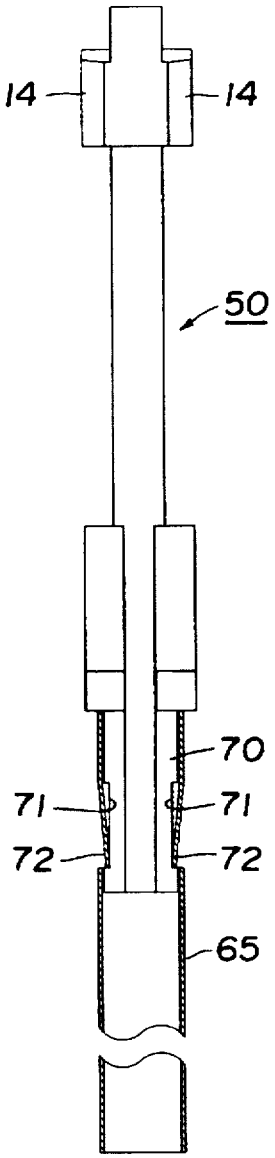
FIG. 29 is a diagrammatic longitudinal sectional view showing the state in which a barrel body and the slider of the first example are assembled.

FIG. 25 shows an example similar to the fifth modification, in which the external container 67 is composed of two separate parts joined by a heat-shrinkable resin tube. The inside surface of the heat-shrinkable resin tube 69 is coated with an adhesive, and the adhesive is melted at the same time as the heat shrinkage of the resin tube 69, so that the resin tube 69 is bonded to the external container 67.

A mechanism for preventing an external container from rotating with respect to a slider will be described below. This mechanism is effective, particularly when an external container the curving action of which has a directional property is used, as in the case of the above-described fourth modification. The external container is prevented from rotating with respect to the slider, and can be fixed at all times in a position in which the external container can be easily curved.

Figure 30:
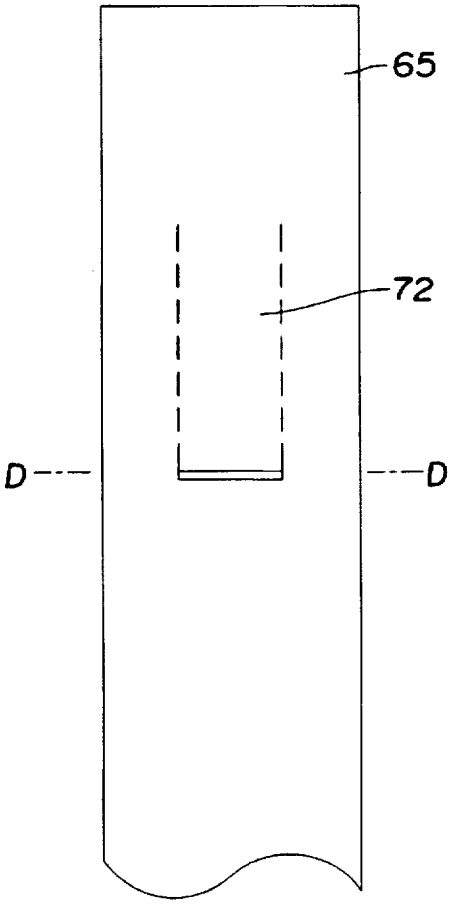
FIG. 30 is a front elevational view showing the essential portion of a modification of FIG. 26.
Figure 31:
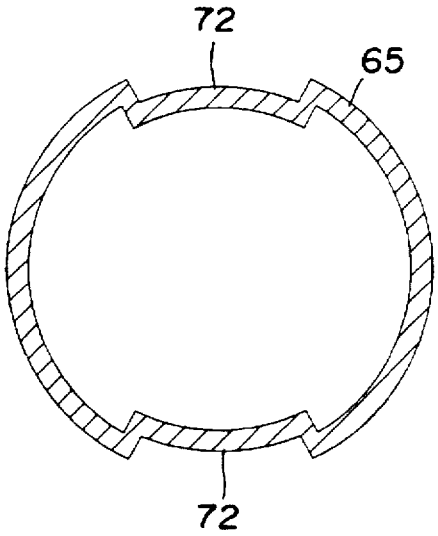
FIG. 31 is a cross-sectional view taken along line D—D of FIG. 30.

A first example will be described below with reference to FIGS. 26 to 29. Engagement projections 72 are formed in a rear end portion of the external container 65. The respective engagement projections 72 engage with recesses 71 formed in a fitting portion 70 of the slider 50, thereby preventing the external container 65 and the slider 50 from rotating with respect to each other. In the first example, the engagement projections 72 are formed by making C-shaped cuts in the peripheral face of the external container 65 and bending the C-shaped cuts inward. However, as shown in FIGS. 30 and 31, the engagement projections 72 may be formed by making cuts, each of which corresponds to only one side of a C-like shape, in the external container 65 and bending the cuts inward to form square shapes, as by pressing. Although the engagement projections 72 are provided at the opposite two locations so that the engagement (connection) between the external container 65 and the slider 50 can be made secure, an engagement projection may be provided at one location. Incidentally, the recesses 71 and the engagement projections 72 are engaged with each other so that the external container 65 and the slider 50 can be bent at the portion of engagement between the recesses 71 and the engagement projections 72. A window 66 which allows the external container 65 to be easily curved is formed in an intermediate portion of the external container 65 so that the mechanical pencil 19 can be far more easily projected and retracted from and into the barrel body 1. This cutout 66 is formed at a location which is 90 degrees shifted from either of the engagement projections 72 so as not to hinder the bending at the aforesaid portion of engagement (the engagement between the recesses 71 and the engagement projections 72). In other words, as described previously, the smoothness of projection and retraction of the mechanical pencil 19 from and into the barrel body 1 is improved by the curving of the external container 65 due to the cutout 66 and the bending of the external container 65 and the slider 50 at the portion of engagement.

In addition, the curvature of the external container 65 is reduced by the bending of the external container 65 and the slider 50 at the portion of engagement, so that a lead can be smoothly fed forward.

Although the external container 65 used in this example is prepared by forming the engagement projections and the window in a metal sheet in advance and forming the metal sheet into a tubular shape, such engagement projections or window may be formed in a tubular metal pipe, as by machining.

Figure 32:
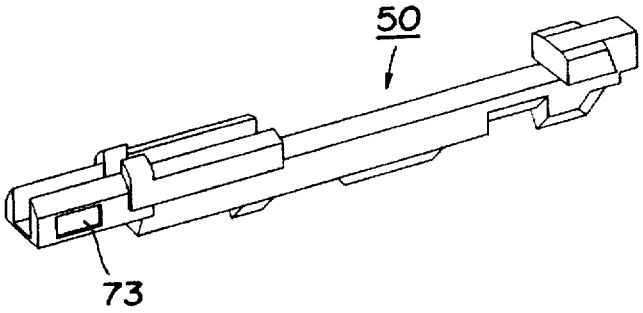
FIG. 32 is a perspective view of a slider, showing a second example of the rotation preventing mechanism.

FIG. 32 is a view showing a second example in which recesses which serve as engagement receiving portions are formed as recesses (rectangular recesses) 73 each of which is surrounded by four side walls. Since the width of each of the recesses 73 is made equal to the width of each of the engagement projections 72 of the external container 65, the external container 65 and the slider 50 become difficult to bend, but the external container 65 and the slider 50 can be more securely fixed to each other so that they can be far more securely prevented from being accidentally rotated by operation.

Figure 33:
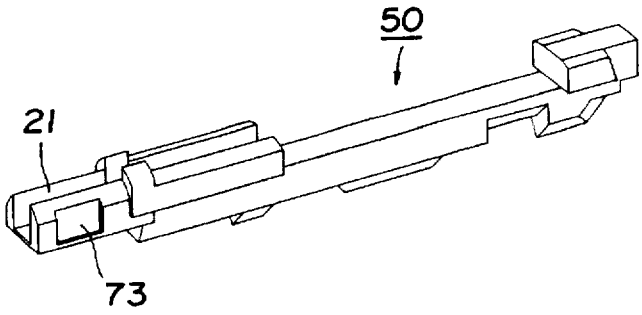
FIG. 33 is a perspective view of a slider, showing a third example of the rotation preventing mechanism.

FIG. 33 is a view showing a third example in which each of the recesses 73 of the second example has one open side. Specifically, the longer side of each of the recesses 73 that extends along the groove 21 is opened. As compared with the above-described second example, the property of bending of the external container 65 and the slider 50 is improved and a mold for forming the slider 50 is simplified.

Figure 34:
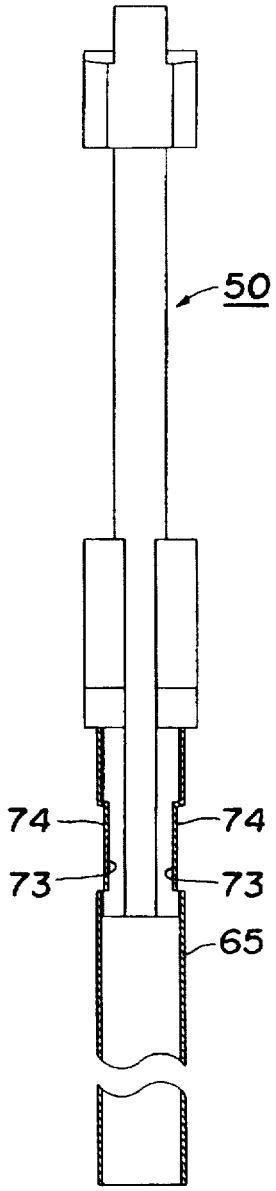
FIG. 34 is a longitudinal sectional view of a fourth example of the rotation preventing mechanism, showing the state in which an external container and a slider are assembled.

FIG. 34 is a view showing a fourth example in which engagement projections 74 are formed on the external container 65 in parallel with the surface of the external container 65, and the parallel engagement projections 74 are held in surface contact with the recesses 73 so that the external container 65 and the slider 50 are securely fixed to each other. Incidentally, even in the case of the tapered engagement projections 72 shown in FIG. 27, if each of the recesses 73 is formed into a tapered shape, the respective engagement projections 72 can be brought into surface contact with the recesses 73 so that the engagement projections 72 and the recesses 73 can be fixed far more securely.

Figure 35:
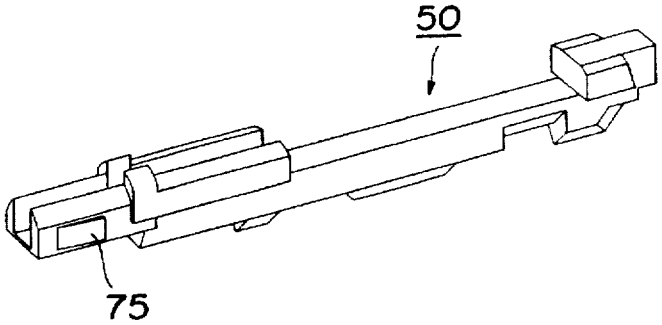
FIG. 35 is a perspective view of a slider, showing a fifth example of the rotation preventing mechanism.
Figure 36:
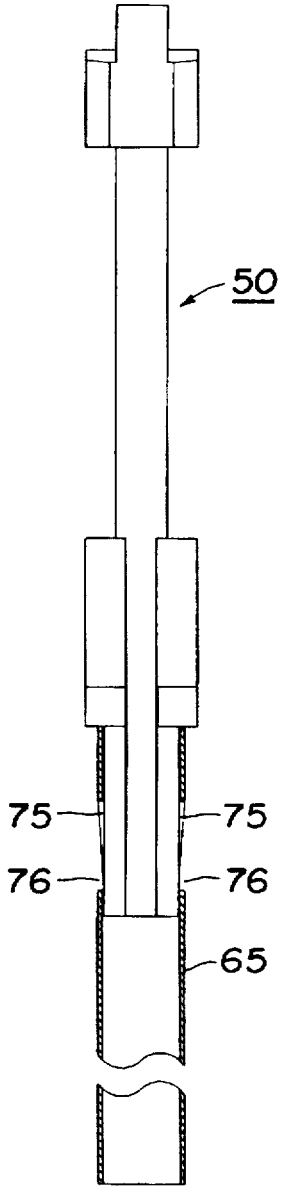
FIG. 36 is a longitudinal sectional view showing the state in which an external container and the slider of the fifth example are assembled.

FIGS. 35 and 36 are views showing a fifth example in which arrow-shaped projections 75 are formed on the slider 50 instead of the above-described recesses and engagement holes 76 for engagement with the respective projections 75 are formed in the external container 65. The fifth embodiment is intended to facilitate the working of the engagement receiving portions (the engagement holes 76).

In accordance with the present invention, there is provided a multiplex writing instrument in which a plurality of writing elements including at least one mechanical pencil are provided in a barrel body and are respectively urged rearward by resilient members, the writing elements being arranged so that a selected writing element is projected from the barrel body when a pressure member secured to a rear end of the selected writing element is made to move forward. The mechanical pencil comprises an external member connected to a corresponding pressure member, and a lead feeding mechanism disposed inside the external member, and a knock member for operating the lead feeding mechanism is disposed on the corresponding pressure member. Accordingly, the backward movement of a lead during writing is prevented and the resilient force of the spring of the lead feeding mechanism need not be increased, so that the mechanical pencil can be securely operated without the risk of breaking the lead by a lead retaining force.

I claim:

1. A multiplex writing instrument in which a plurality of writing elements including at least one mechanical pencil are provided in a barrel body and are respectively urged rearward by resilient members, said writing elements being arranged so that a selected writing element is projected from said barrel body when a pressure member secured to a rear end of said selected writing element is made to move forward, and in which said mechanical pencil comprises an external member connected to a corresponding pressure member, and a lead feeding mechanism disposed inside said external member, a knock member for operating said lead feeding mechanism being disposed on said corresponding pressure member.

2. A multiplex writing instrument according to claim 1, wherein said pressure members are incorporated in said barrel body.

3. A multiplex writing instrument according to claim 1, wherein said external member is a flexible member.

4. A multiplex writing instrument in which a plurality of writing elements including at least one mechanical pencil are provided in a barrel body and are respectively urged rearward by resilient members, said writing elements being arranged so that a selected writing element is projected from said barrel body when a pressure member secured to a rear end of said selected writing element is made to move forward, and in which said mechanical pencil comprises an external member non-rotatably connected to a corresponding pressure member, and a lead feeding mechanism disposed inside said external member, a knock member for operating said lead feeding mechanism being disposed on said corresponding pressure member, said external member being a flexible member.

* * * * *